US006752620B2

(12) United States Patent
Heier et al.

(10) Patent No.: US 6,752,620 B2
(45) Date of Patent: Jun. 22, 2004

(54) LARGE SCALE VORTEX DEVICES FOR IMPROVED BURNER OPERATION

(75) Inventors: Kevin Ray Heier, Macungie, PA (US); Mahendra Ladharam Joshi, Allentown, PA (US); Jeannine M. Harris, Devon, PA (US); Mark Daniel D'Agostini, Hazleton, PA (US); Aleksandar Georgi Slavejkov, Allentown, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 28 days.

(21) Appl. No.: 10/062,597

(22) Filed: Jan. 31, 2002

(65) Prior Publication Data

US 2003/0143502 A1 Jul. 31, 2003

(51) Int. Cl.[7] ..... F23C 5/00; F23C 7/00

(52) U.S. Cl. ..... 431/8; 431/9; 431/173; 431/181; 431/187

(58) Field of Search ..... 431/8, 9, 10, 173, 431/181, 182, 187

(56) References Cited

U.S. PATENT DOCUMENTS

| | | | | |
|---|---|---|---|---|
| 4,082,495 A | | 4/1978 | Lefebvre | 431/183 |
| 4,160,640 A | | 7/1979 | Maev et al. | 431/9 |
| 4,445,339 A | | 5/1984 | Davis, Jr. et al. | 60/749 |
| 4,548,576 A | | 10/1985 | Chesters | 431/202 |
| 5,179,832 A | | 1/1993 | Barcza et al. | 60/261 |
| 5,186,620 A | | 2/1993 | Hollingshead | 431/354 |
| 5,669,766 A | | 9/1997 | Hufton | 431/187 |
| 5,743,723 A | * | 4/1998 | Iatrides et al. | 431/8 |
| 5,762,486 A | * | 6/1998 | Leger | 431/8 |
| 5,904,475 A | * | 5/1999 | Ding | 431/8 |
| 5,951,768 A | | 9/1999 | Hahn et al. | 118/715 |
| 6,190,158 B1 | * | 2/2001 | Legiret et al. | 431/8 |

* cited by examiner

*Primary Examiner*—Alfred Basichas
(74) *Attorney, Agent, or Firm*—Keith D. Gourley

(57) ABSTRACT

A symmetric device for stabilization of a flame includes a primary oxidant pipe and a fuel pipe. The fuel pipe is internal to the primary oxidant pipe creating a primary oxidant conduit. A secondary oxidant pipe is internal to the fuel pipe creating a fuel conduit. A primary oxidant source supplies oxidant to the primary oxidant conduit. A fuel source supplies fuel to the fuel conduit. A secondary oxidant source supplies oxidant to the secondary oxidant pipe. The first oxidant velocity is greater than the second oxidant velocity and the fuel velocity is less than the second oxidant velocity. The primary oxidant pipe end extends past the fuel pipe forward end and the fuel pipe forward end extends past the secondary oxidant pipe end. A mismatch in velocity between fuel and oxidant generates a large scale vortex. An asymmetric embodiment is also provided.

26 Claims, 2 Drawing Sheets

LARGE SCALE VORTEX DEVICES FOR IMPROVED BURNER OPERATION

BACKGROUND OF THE INVENTION

The present invention is directed to fuel burners, and, more particularly, to a flame retention device for a fuel burner for use in a combustion application.

It is well known that some sort of flame stabilizing device is required in most combustion applications. Numerous U.S. Patents describe mechanical flame retention devices for use, for example, in process heaters, gas turbine combustors, waste gas flares, jet engine afterburners, gas-fired appliances, power generators and chemical reactors.

For example, U.S. Pat. No. 4,082,495 (Lefebvre) teaches a flame retention head assembly for use in the air tube of a fuel burner having a fuel nozzle in the tube.

U.S. Pat. No. 4,445,339 (Davis, Jr. et al.) teaches a flameholder for a gas turbine combustor that includes a primary flameholder such as an elongated V-gutter extending across a main flow stream of gas within the combustor. Vortices are shed by the trailing edges of the flameholder.

U.S. Pat. No. 4,548,576 (Chesters) teaches an apparatus for the burning of combustible gas. The device includes a flare having a vertical pipe connected to a gas source and a pipe having a flame stabilizer. The flame stabilizer is a cylinder coaxial with and lying within the pipe where the length of the cylinder is at least ten times the radial distance between the inner circumference of the pipe and the outer circumference of the cylinder. The cylinder has a cone at the outlet of the pipe that diverges at an angle of twenty to forty degrees to the horizontal.

U.S. Pat. No. 5,179,832 (Barcza) discloses a flameholder construction for gas turbine engines. The flameholder includes an augmenter and a fuel spray ring. A circumferential gutter is located downstream of the spray ring and a circumferential shroud is located radially inside the gutter. A circumferential outer shroud is located radially outside the gutter. These shrouds are arranged to confine fuel from the spray ring as well as a portion of the airflow to the zone of the gutter.

U.S. Pat. No. 5,186,620 (Hollinshead) teaches an inshot gas burner nozzle having a flame retention insert that enhances flame stability and reduces noise. The insert includes a central opening, secondary openings of smaller diameter arranged circularly around the central insert and a plurality of restricted peripheral openings in the form of stepped notches. The nozzle further includes plenum chambers which have restricted outlets that create back pressure within the plenums to improve cross-ignition of adjacent nozzles.

U.S. Pat. No. 5,669,766 (Hufton) discloses a fossil fuel air burner nozzle that directs streams of mixed fossil fuel and air into a combustion chamber. The nozzle includes a primary nozzle having nested, coaxial passages connected to a common supply conduit for the receipt of a flow of mixed fossil fuel and air and wherein the outer one of the nested passages is provided at its inlet end with a wall which lies in a plane normal to its axis. The wall has apertures which are symmetrically spaced about the axis.

U.S. Pat. No. 5,951,768 (Hahn) discloses a method of stabilizing a strained flame in a stagnation flow reactor. By causing a highly strained flame to be divided into a large number of equal size segments, this invention stabilizes a highly strained flame that is on the verge of extinction. The flame stabilizer is an annular ring mounted coaxially and coplanar with a substrate and has a number of vertical pillars mounted on the top surface thereby increasing the number of vertical pillars mounted on the top surface. The number of azimuthal nodes into which the flame is divided is increased. The flame is thereby preserved in an asymmetric structure necessary for stability.

Unfortunately, all of these devices add significantly to the cost and complexity of the various burner apparatuses. In some applications, the devices must be made of expensive high temperature alloys to withstand the heat of both the nearby flame and radiation from the furnace.

Newer low polluting burners are limited by the flameholder design. The stabilization mechanism relies on flames that range from stoichiometric to fuel rich. NOx formation is promoted in this combustion regime. For example, in U.S. Pat. No. 4,160,640 (Maev), a vortex burner is described that attempts to stabilize the flame without mechanical flameholders by swirling the gas flow. However, these inventions also promote combustion in the stoichiometric regime leading to relatively high NOx formation.

The primary objective of the invention is to stabilize combustion without the aid of a mechanical flame retention device. It is a further objective of the device to provide such stability in a way that promotes low formation of pollutants, especially NOx. A still further objective of the invention is to accomplish the above objectives with an apparatus constructed from common, inexpensive materials.

BRIEF SUMMARY OF THE INVENTION

A first embodiment of the present invention is directed to a "symmetric" device for stabilization of a flame in a combustion apparatus. The symmetric device includes a primary oxidant pipe having a primary oxidant pipe internal surface and a primary oxidant pipe forward end, and a fuel pipe having a fuel pipe internal surface, a fuel pipe external surface, and a fuel pipe forward end. The fuel pipe is disposed at least partially internal to the primary oxidant pipe. A hollow primary oxidant flow conduit is formed between the fuel pipe external surface and the primary oxidant pipe internal surface. The device also includes a secondary oxidant pipe having a secondary oxidant pipe external surface and a secondary oxidant pipe forward end. The secondary oxidant pipe is disposed at least partially internal to the fuel pipe. A hollow fuel flow conduit is formed between the secondary oxidant pipe external surface and the fuel pipe internal surface. The secondary oxidant pipe has an internal, secondary oxidant conduit. The device also includes a primary oxidant flow source for supplying oxidant at a first oxidant flow velocity to the primary oxidant conduit, a fuel flow source for supplying a fuel at a fuel flow velocity to the fuel flow conduit, and a secondary oxidant flow source for supplying oxidant at a second oxidant flow velocity to the secondary oxidant conduit. The first oxidant flow velocity is greater than the second oxidant flow velocity and the fuel flow velocity is less than the second oxidant flow velocity. The primary oxidant pipe end extends past the fuel pipe forward end and the fuel pipe forward end extends past the secondary oxidant pipe end. A mismatch in velocity between flowing fuel and flowing oxidant generates a large scale vortex of the oxidant and fuel as they mix.

Preferably, the first oxidant velocity is in a range from about 30 feet per second to about 90 feet per second, the fuel flow velocity is in a range from about 2 feet per second to about 6 feet per second, and the second oxidant flow velocity is in a range from about 15 feet per second to about 45 feet per second. Also, more broadly, the first oxidant flow velocity is preferably greater than 30 ft./sec., the fuel flow velocity is preferably less than 20 ft./sec. and the second oxidant flow velocity is preferably between the first oxidant velocity and the fuel flow velocity.

Optionally, the various pipes may have a round cross-sectional shape wherein the primary oxidant pipe end extends past the fuel pipe forward end by a first length and the fuel pipe forward end extends past the secondary oxidant pipe end by a second length, and wherein a ratio of the first length to the fuel pipe diameter is approximately 1 to 3, a ratio of the first length to the primary oxidant pipe diameter is approximately 1 to 3, and a ratio of the second length to the secondary oxidant pipe diameter is approximately 1 to 3.

A second embodiment of the present invention is directed to an "asymmetric" device for stabilization of a flame in a combustion apparatus. The asymmetric device includes an oxidant pipe having an oxidant pipe internal surface and an oxidant pipe forward end, and a fuel pipe having a fuel pipe internal surface, a fuel pipe external surface, and a fuel pipe forward end. The fuel pipe is disposed at least partially internal to the oxidant pipe. A hollow oxidant flow conduit is formed between the fuel pipe external surface and the oxidant pipe internal surface. An oxidant feed pipe is connected to the oxidant pipe preferably at an angle to the oxidant pipe such that an oxidant flowing through the oxidant feed pipe is adapted to travel through the oxidant feed pipe and impinge on the fuel pipe external surface and then travel through the oxidant flow conduit to the fuel pipe forward end. An oxidant flow source is provided for supplying the oxidant at an oxidant flow velocity to the oxidant feed pipe. A fuel flow source is provided for supplying a fuel at a fuel flow velocity to the fuel pipe. The oxidant flow velocity is greater than the fuel flow velocity and the oxidant pipe forward end extends past the fuel pipe forward end. Again, a mismatch in velocity between flowing fuel and flowing oxidant generates a large scale vortex of the oxidant and fuel as they mix.

Preferably, the oxidant flow velocity is in a range from about 10 feet per second to about 50 feet per second, the fuel flow velocity is in a range from about 2 feet per second to about 10 feet per second, and the oxidant feed pipe is connected at an angle of about ninety degrees to the oxidant pipe.

Optionally, the various pipes of the device of the second embodiment may have a round cross-sectional shape wherein the oxidant pipe forward end extends past the fuel pipe forward end by a first length and the fuel pipe extends past an uppermost point of an internal surface of the oxidant feed pipe by a second length, wherein a ratio of the first length to the oxidant feed pipe diameter is approximately 0.5 to 2, wherein a ratio of the second length to the fuel pipe diameter is greater than or equal to about 1, and wherein a ratio of the oxidant pipe diameter to the fuel pipe diameter is approximately 1.2 to 1.8.

DETAILED DESCRIPTION OF THE INVENTION

The present invention comprises a new method of stabilizing a flame in an industrial scale burner. A mismatch in velocity between coflowing fuel and oxidant streams contained within an outer pipe generates a large scale vortex (LSV). For example, in one preferred "symmetric" embodiment described in detail below, a primary oxidant stream has a high velocity (preferably >30 ft./sec.), a fuel stream has a low velocity (preferably <20 ft./sec. and more preferably <10 ft./sec.) and a secondary oxidant stream has an intermediate velocity. The fuel stream cannot satisfy the large entrainment requirement of the adjacent high velocity primary oxidant stream. As a result, part of the oxidant stream is bent back on itself to provide its own entrainment gas. The resulting vortex recirculates oxidant, fuel, and some products of combustion back towards the fuel pipe opening. The low or even negative velocity of the vortex gases allows the flame to propagate faster than the gases are ejected from the burner, thereby anchoring and stabilizing the flame. The device provides for the secondary, lower velocity, oxidant stream to improve stability during start-up and at lower firing rates.

Figure 1:
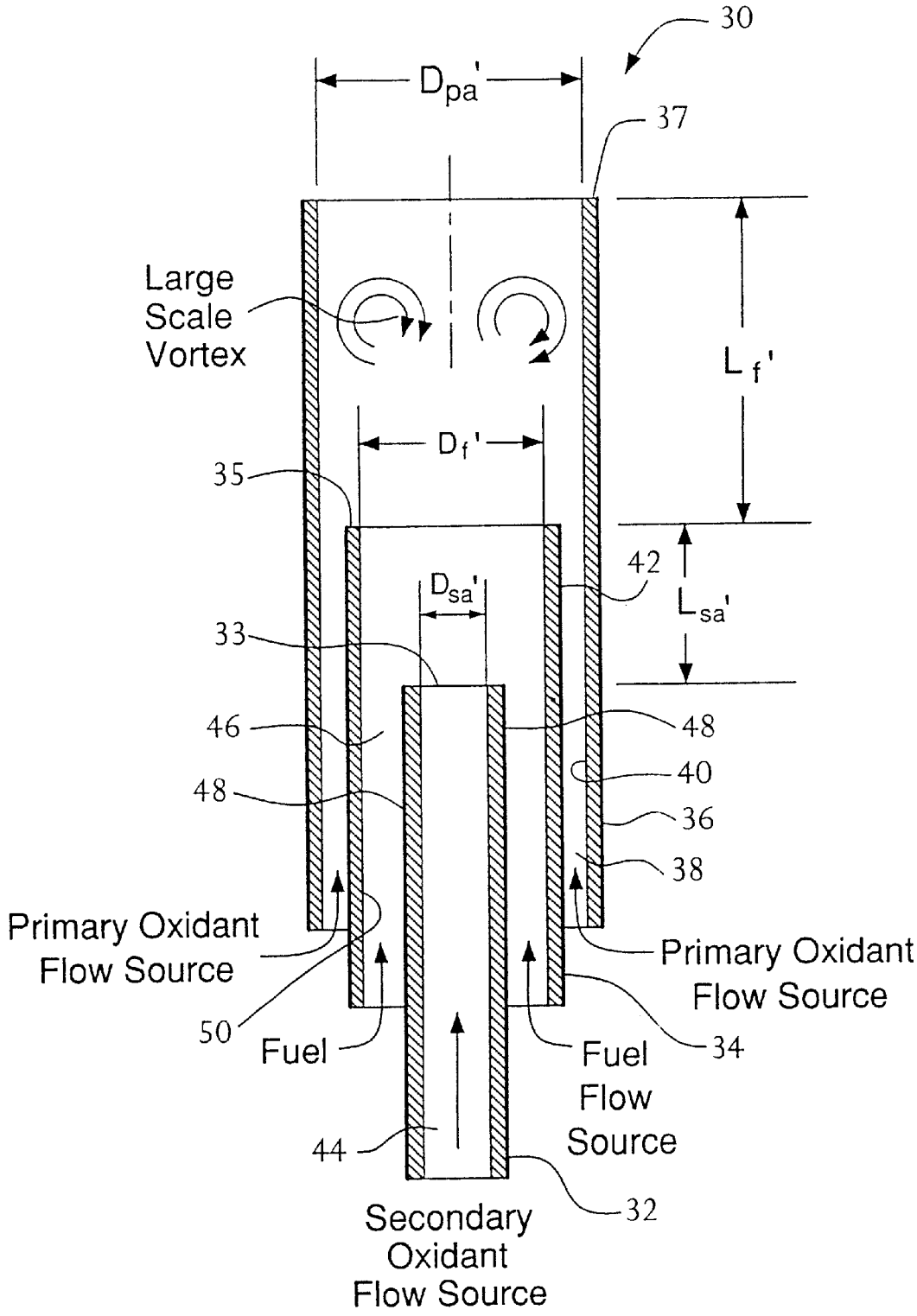
FIG. 1 is a simplified, front, elevational, cross-sectional view of a device for stabilization of a flame in a combustion apparatus in accordance with a first preferred embodiment of the present invention.

The present invention includes a first embodiment which generates a symmetric large scale vortex. The present invention also includes a second symmetric embodiment which has an asymmetric structure to generate an asymmetric large scale vortex Referring now to the drawings, there is shown in FIG. 1 a device for stabilization of a flame in a combustion apparatus 30 in accordance with the first preferred embodiment of the present invention wherein the structure is symmetric. Here, the device 30 is comprised of a secondary oxidant pipe 32 recessed inside a fuel pipe 34, which is further recessed inside an outer, primary oxidant pipe 36. A primary oxidant pipe forward end 37 extends past a fuel pipe forward end 35 which, in turn, extends past a secondary oxidant pipe forward end 33. A primary oxidant (such as air) is introduced axially, at relatively high velocity and flow rate through a hollow, primary oxidant flow conduit 38 that is formed between the internal surface 40 of the primary oxidant pipe 36 and the external surface 42 of the fuel pipe 34. A secondary oxidant (which may be the same oxidant as the primary oxidant, such as air) is directed through the secondary oxidant pipe 32 (that is, through an internal secondary oxidant conduit 44) at a lower velocity and flow rate. Fuel is directed through a hollow, fuel flow conduit 46 formed between the secondary oxidant pipe external surface 48 and the fuel pipe internal surface 50.

Figure 2:
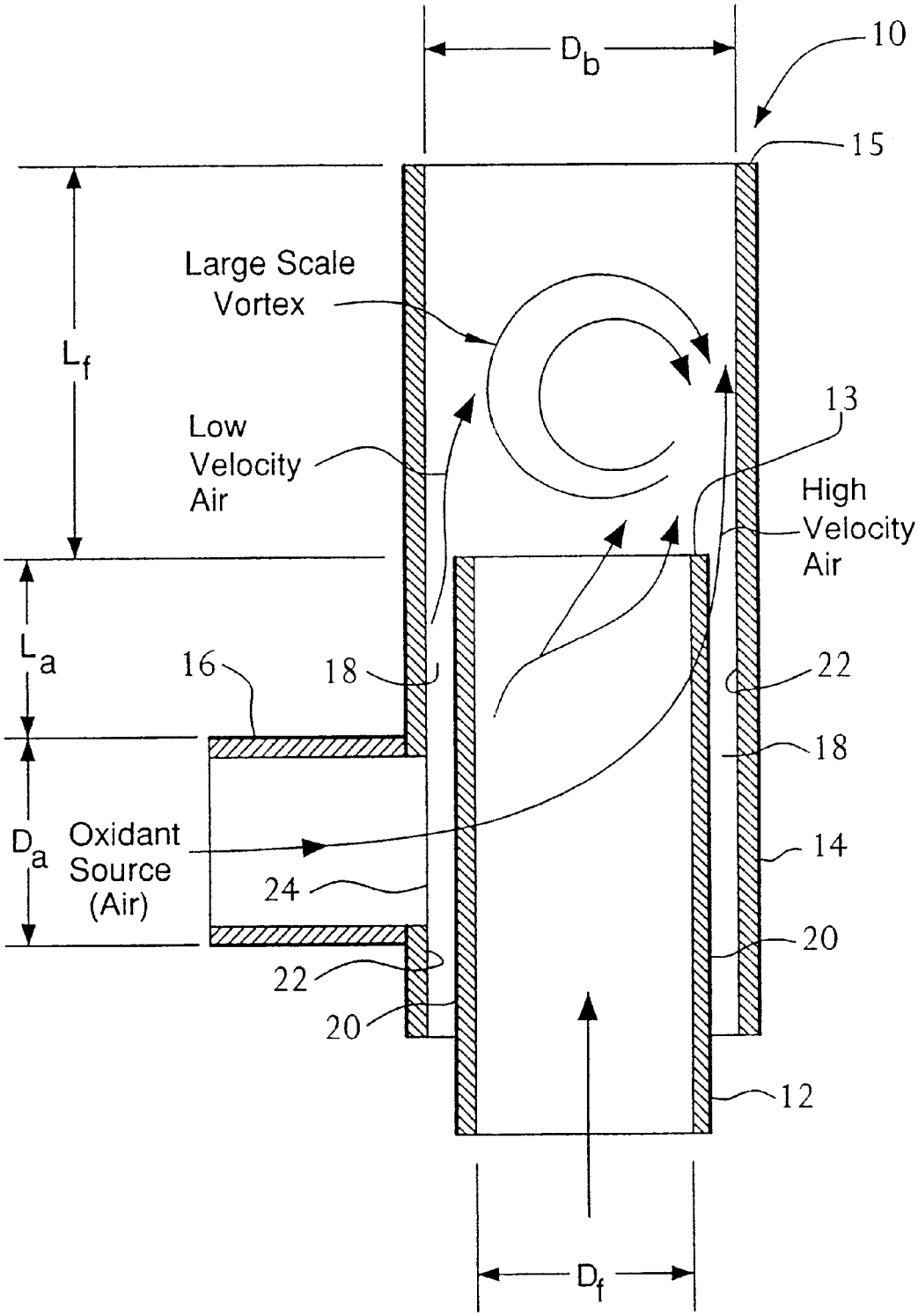
FIG. 2 is a simplified, front, elevational, cross-sectional view of a device for stabilization of a flame in a combustion apparatus in accordance with a second preferred embodiment of the present invention.

Next, there is shown in FIG. 2 a device for stabilization of a flame in a combustion device 10 in accordance with the second preferred embodiment of the present invention wherein the structure is asymmetric. The device for stabilization 10 is comprised of a fuel pipe 12 through which fuel from a fuel source flows, recessed inside a larger pipe, i.e., oxidant pipe 14, into which an oxidant (such as air) from an oxidant source is introduced through an oxidant feed pipe 16 at an angle that is preferably perpendicular to fuel flow through the fuel pipe 12. The oxidant pipe 14 has an oxidant pipe forward end 15 and the fuel pipe 12 has a fuel pipe forward end 13. The oxidant pipe forward end 15 extends past the fuel pipe forward end 13. The oxidant flow naturally segregates in an oxidant flow conduit 18, i.e., a hollow, cylindrical annulus formed between the fuel pipe external surface 20 and the oxidant pipe internal surface 22. The flow segregates into a high velocity flow that is opposite the oxidant feed pipe inlet 24 to the oxidant flow conduit 18 and into a low velocity flow adjacent to the oxidant feed pipe inlet 24. See FIG. 1. Thus, the requirement for a high velocity primary oxidant stream and a lower velocity, secondary oxidant stream is satisfied.

The symmetric design of the device of the first embodiment 30 provides for a lower pressure drop than the asymmetric second embodiment 10 and eliminates direct flame impingement on a burner and uneven furnace heating inherent to the asymmetric design. The relatively low temperatures experienced by either embodiment of the present invention allow construction using common, inexpensive materials.

Preferably, the oxidant is air and natural gas is the fuel. However, any appropriate oxidant in combination with any appropriate fuel, as known in the art, may be used.

For the specific case of an oxidant as air and natural gas fuel, various optimal ranges for flow (e.g., $V_f$=2–6 ft./sec.; $V_{pa}$=30–90 ft./sec.; $V_{sa}$=15–45 ft./sec.) and non-dimensional geometric (e.g., length/diameter) parameters have been determined for a cylindrical design of the devices of the present invention. It is noted that while use of cylindrical pipes will operate properly in accordance with the present invention, numerous other shapes of pipes will operate properly so long as the relative speeds of the fuel and oxidants are in supplied in accordance with the present invention.

In the symmetric first embodiment of the device 30, performance depends on the distance, designated as $L_f'$ in FIG. 1, from the fuel pipe forward end 35, i.e., its outlet, to the primary oxidant feed pipe forward end 37. The distance $L_f'$ is preferably approximately 1–3 times the internal diameter of the fuel pipe, $D_f'$. The distance $L_{sa}'$ (as seen in FIG. 2), between the secondary oxidant pipe forward end 33 and the fuel pipe forward end 35 is also preferably approximately 1–3 times the secondary oxidant pipe diameter, $D_{sa}'$. Finally, the distance $L_f'$ is preferably approximately 1–3 times the internal diameter of the primary oxidant pipe, $D_{pa}'$.

For the device 30 of the first embodiment of the present invention, the following table, Table 1, gives specific velocity ranges and dimensionless ratios for obtaining a stable stream-wise vortex in the primary oxidant pipe 36. The preferred average velocity ranges for fuel is about 2 to 6 ft./sec., for primary oxidant is about 30 to 90 ft./sec., and for secondary oxidant is about 15 to 45 ft./sec. The symbols used are seen in FIG. 1.

TABLE 1

| LSV Firing Rate | Velocity Range (ft./sec.) | | | Ratio | Ratio | Ratio |
|---|---|---|---|---|---|---|
| MM Btu/Hr | $V_{pa}'$ | $V_f'$ | $V_{sa}'$ | $L_f'/D_f'$ | $L_f'/D_{pa}'$ | $L_{sa}'/D_{sa}'$ |
| 0.25 to 5 | 30–90 | 2–6 | 15–45 | 1 to 3 | 1 to 3 | 1 to 3 |

Similarly, in the second asymmetric embodiment of the device 10, performance depends upon the distance from the fuel pipe forward end 13 relative to both the position of the oxidant feed pipe 16 and of the oxidant pipe forward end 15. Preferably, the fuel pipe forward end 13 is positioned from 0% to 50% of the distance between the oxidant pipe forward end 15 and the top of the oxidant feed pipe 16. That is, performance depends on the distance, designated as $L_f$ in FIG. 2, from the fuel pipe forward end 13 to the oxidant pipe forward end 15, the distance, designated as $L_a$ in FIG. 1, from the top of the oxidant feed pipe 16 to the fuel pipe forward end 13, and the internal diameters of the oxidant feed pipe $D_a$, the fuel pipe $D_f$, and the oxidant pipe, $D_b$. The ratio, $L_a/D_a$ is preferably approximately 0.5 to 2, the ratio $L_f/D_f$ is preferably greater than 1, and the ratio $D_b/D_f$ is preferably approximately 1.2 to 1.8.

For the device 10, the following table, Table 2, gives specific velocity ranges and dimensionless ratios for obtaining a stable stream-wise vortex in the oxidant pipe 14. The preferred average velocity ranges for fuel is about 2 to 10 ft./sec. and for oxidant is about 10 to 50 ft./sec. The symbols are used in FIG. 2.

TABLE 2

| LSV Firing Rate | Velocity Range (ft./sec.) | | Ratio | Ratio | Ratio |
|---|---|---|---|---|---|
| MM Btu/Hr. | $V_a$ | $V_f$ | $L_a/D_a$ | $L_f/D_f$ | $D_b/D_f$ |
| 0.1 to 4 | 10–50 | 2–10 | 0.5–2 | >1 | 1.2–1.8 |

The devices 10 and 30 of the present invention are fluid based flame stabilizers which can provide a very fuel-lean flame at equivalence ratio as low as phi=0.05. At this ratio, the combustion air is approximately 20 times more than the theoretically required airflow. The flame stability is maintained at high excess airflow due to fluid flow reversal caused by a stream-wise vortex which, in turn, causes internal flue gas recirculation and provides air/fuel mixture preheating and intense mixing of fuel, air, and combustion products to create ideal conditions for flame stability. The LSV flame is found to anchor on the fuel pipe tip. Under normal operation, device internal components remain at less than 1000° F. The operation of the devices of the present invention, based on the stream-wise vortex principle, make them inherently more stable at lower firing rate and at extremely low equivalence ratio. This is beneficial to lower peak flame temperatures and reduces both thermal and prompt NOx formation. Table 3 (below) gives laboratory data on the devices of the present invention under fuel lean firing conditions. At low firing rate and extremely fuel-lean stoichiometry, a flame with extremely low peak temperatures (less than 1600° F.) and NOx emissions less than 2 to 3 ppmv is produced. This flame gets more stable as we increase the primary air through the relatively narrow annular passage. The LSV flame produces very low NOx emissions due to excellent mixing, avoiding fuel-rich zones for prompt NOx formation (as observed in traditional flameholders) and completing overall combustion under extremely fuel-lean conditions. Exhaust gas recycling in the large-scale vortex also reduces flame temperature due to product gas dilution.

TABLE 3

| LSV Firing Only, Furnace between 1000–1500 degrees F. | | | | | | | | |
|---|---|---|---|---|---|---|---|---|
| LSV | Comb. Air | Emissions (dry) | | | | Corrected | Corrected | Corrected |
| Firing Rate (MM Btu/Hr) | Theo (%) | $O_2$ (%) | CO (ppm) | $CO_2$ (%) | NO (ppmv) | NO @ 3% $O_2$ (ppmv) | NO @ 3% $O_2$ (lb/MMBtu) | NO @ 3% $O_2$ (mg/$Nm_3$) |
| 0.5 | 550 | 17.6 | 0.25 | 0.18 | 0.4 | 2.1 | 0.003 | 4.3 |
| 1 | 450 | 18.3 | 0.25 | 0.27 | 0.5 | 3.3 | 0.004 | 6.8 |
| 2 | 255 | 15.6 | 2.4 | 0.73 | 1.8 | 6.0 | 0.008 | 12.3 |

Nearly every combustion device currently uses some sort of flame retention device ("flame-holder", "flame-stabilizer", etc.). The devices 10, 30 of the present invention are an improvement over current "flame-holder" technology which uses physical devices to interrupt the flow of oxidant and/or fuel, creating small scale re-circulation vortices to anchor the burner flames. However, traditional flame-holders are most effective when fuel and oxidant streams have similar velocities relative to one another. At significantly mismatched oxidant and fuel flow rates, such as in fuel lean combustion, the small-scale vortices are not able to sustain the flame. By contrast, the device stability of the present invention improves with increasing velocity mismatch. Flames have been maintained at equivalence ratio phi=0.05 (i.e., 20 times the air required for stoichiometric combustion). Another flame-holder disadvantage is its generally large surface exposure to high temperatures from both the flame and the hot furnace. For this reason flame-holders must be made from expensive, high temperature alloys. Despite these measures, flameholders are often eroded or degraded after long exposure, which in turn reduces their effectiveness. A third disadvantage of conventional flame-holders is $NO_x$ production. The anchoring flames range from stoichiometric to fuel rich. Both conditions result in increased $NO_x$. LSV anchoring flames are always fuel lean, which produces cleaner, lower temperature combustion.

The major advantages of the devices of the present invention include elimination of a physical flame-holding device which allows use of inexpensive materials of construction (for example, carbon steel, aluminized carbon steel, stainless steel, or more expensive high temperature steel alloys), simplified manufacture, and a reduced possibility for damage and degraded burner performance. Additionally, improved stability for extremely fuel lean combustion is provided. Stability improves with increasing air flow. Lower peak flame temperatures as well as lower NOx emissions occur. The devices of the present invention may operate either as a stand-alone burner or as one component in a staged combustion burner.

Although illustrated and described herein with reference to specific embodiments, the present invention nevertheless is not intended to be limited to the details shown. Rather, various modifications may be made in the details within the scope and range of equivalents of the claims without departing from the spirit of the invention.

What is claimed is:

1. A device for stabilization of a flame in a combustion apparatus, comprising:

(a) a primary oxidant pipe having a primary oxidant pipe internal surface and a primary oxidant pipe forward end;

(b) a fuel pipe having a fuel pipe internal surface, a fuel pipe external surface, and a fuel pipe forward end, said fuel pipe disposed at least partially internal to said primary oxidant pipe, wherein a hollow primary oxidant flow conduit is formed between said fuel pipe external surface and said primary oxidant pipe internal surface;

(c) a secondary oxidant pipe having a secondary oxidant pipe external surface and a secondary oxidant pipe forward end, said secondary oxidant pipe disposed at least partially internal to said fuel pipe, wherein a hollow fuel flow conduit is formed between said secondary oxidant pipe external surface and said fuel pipe internal surface, and wherein said secondary oxidant pipe has an internal, secondary oxidant conduit;

(d) a primary oxidant flow source for supplying oxidant at a first oxidant flow velocity to said primary oxidant conduit;

(e) a fuel flow source for supplying a fuel at a fuel flow velocity to said fuel flow conduit;

(f) a secondary oxidant flow source for supplying oxidant at a second oxidant flow velocity to said secondary oxidant conduit;

(g) wherein said first oxidant flow velocity is greater than said second oxidant flow velocity and said fuel flow velocity is less than said second oxidant flow velocity; and (h) wherein said primary oxidant pipe end extends past said fuel pipe forward end and said fuel pipe forward end extends past said secondary oxidant pipe end;

whereby a mismatch in velocity between flowing fuel and flowing oxidant generates a large scale vortex of the oxidant and fuel as they mix.

2. The device for stabilization of a flame of claim 1, wherein the first oxidant velocity is in a range from about 30 feet per second to about 90 feet per second.

3. The device for stabilization of a flame of claim 1, wherein the fuel flow velocity is in a range from about 2 feet per second to about 6 feet per second.

4. The device for stabilization of a flame of claim 1, wherein the second oxidant flow velocity is in a range from about 15 feet per second to about 45 feet per second.

5. The device for stabilization of a flame of claim 1, wherein the first oxidant flow velocity is greater than 30 ft./sec., the fuel flow velocity is less than 20 ft./sec. and the second oxidant flow velocity is between the first oxidant velocity and the fuel flow velocity.

6. A device for stabilization of a flame in a combustion apparatus, comprising:

(a) a primary oxidant pipe having a primary oxidant pipe internal surface, a circular cross-sectional shape of a primary oxidant pipe diameter, and a primary oxidant pipe forward end;

(b) a fuel pipe having a fuel pipe internal surface, a fuel pipe external surface, a circular cross-sectional shape of a fuel pipe diameter, and a fuel pipe forward end, said fuel pipe disposed coaxial to said primary oxidant pipe, and at least a portion of said fuel pipe disposed internal to said primary oxidant pipe, wherein a hollow cylindrical primary oxidant flow conduit is formed between said fuel pipe external surface and said primary oxidant pipe internal surface;

(c) a secondary oxidant pipe having a secondary oxidant pipe external surface, a circular cross-sectional shape of a secondary oxidant pipe diameter, and a secondary oxidant pipe forward end, said secondary oxidant pipe disposed coaxial to said primary oxidant pipe, and at least a portion of said secondary oxidant pipe disposed internal to said fuel pipe, wherein a hollow cylindrical fuel flow conduit is formed between said secondary oxidant pipe external surface and said fuel pipe internal surface, and wherein said secondary oxidant pipe has an internal secondary oxidant flow conduit;

(d) a primary oxidant flow source for supplying oxidant at a first oxidant flow velocity to said primary oxidant conduit;

(e) a fuel flow source for supplying a fuel at a fuel flow velocity to said fuel flow conduit;

(f) a secondary oxidant flow source for supplying oxidant at a second oxidant flow velocity to said secondary oxidant conduit;

(g) wherein said first oxidant flow velocity is greater than said second oxidant flow velocity and said fuel flow velocity is less than said second oxidant flow velocity; and (h) wherein said primary oxidant pipe end extends past said fuel pipe forward end by a first length and said fuel pipe forward end extends past said secondary oxidant pipe end by a second length;

whereby a mismatch in velocity between flowing fuel and flowing oxidant generates a large scale vortex of the oxidant and fuel as they mix.

7. The device for stabilization of a flame of claim 6, wherein the first oxidant velocity is in a range from about 30 feet per second to about 90 feet per second.

8. The device for stabilization of a flame of claim 6, wherein the fuel flow velocity is in a range from about 2 feet per second to about 6 feet per second.

9. The device for stabilization of a flame of claim 6, wherein the second oxidant flow velocity is in a range from about 15 feet per second to about 45 feet per second.

10. The device for stabilization of a flame of claim 6, wherein a ratio of said first length to said fuel pipe diameter is approximately 1 to 3.

11. The device for stabilization of a flame of claim 6, wherein a ratio of said first length to said primary oxidant pipe diameter is approximately 1 to 3.

12. The device for stabilization of a flame of claim 6, wherein a ratio of said second length to said secondary oxidant pipe diameter is approximately 1 to 3.

13. The device for stabilization of a flame of claim 6, wherein the first oxidant velocity is in a range from about 30 feet per second to about 90 feet per second, the fuel flow velocity is in a range from about 2 feet per second to about 6 feet per second, the second oxidant flow velocity is in a range from about 15 feet per second to about 45 feet per second, a ratio of said first length to said fuel pipe diameter is approximately 1 to 3, a ratio of said first length to said primary oxidant pipe diameter is approximately 1 to 3, and a ratio of said second length to said secondary oxidant pipe diameter is approximately 1 to 3.

14. The device for stabilization of a flame of claim 6, wherein the first oxidant flow velocity is greater than 30 ft./sec., the fuel flow velocity is less than 20 ft./sec. and the second oxidant flow velocity is between the first oxidant velocity and the fuel flow velocity.

15. A device for stabilization of a flame in a combustion apparatus, comprising:

(a) an oxidant pipe having an oxidant pipe internal surface and an oxidant pipe forward end;

(b) a fuel pipe having a fuel pipe internal surface, a fuel pipe external surface, and a fuel pipe forward end, said fuel pipe disposed at least partially internal to said oxidant pipe, wherein a hollow oxidant flow conduit is formed between said fuel pipe external surface and said oxidant pipe internal surface;

(c) an oxidant feed pipe connected to said oxidant pipe, said oxidant feed pipe connected at an angle to said oxidant pipe such that an oxidant flowing through said oxidant feed pipe is adapted to travel through said oxidant feed pipe and impinge on said fuel pipe external surface and then travel through said oxidant flow conduit to said fuel pipe forward end;

(d) an oxidant flow source for supplying the oxidant at an oxidant flow velocity to said oxidant feed pipe;

(e) a fuel flow source for supplying a fuel at a fuel flow velocity to said fuel pipe;

(f) wherein said oxidant flow velocity is greater than said fuel flow velocity; and (g) wherein said oxidant pipe forward end extends past said fuel pipe forward end;

whereby a mismatch in velocity between flowing fuel and flowing oxidant generates a large scale vortex of the oxidant and fuel as they mix.

16. The device for stabilization of a flame of claim 15, wherein the oxidant flow velocity is in a range from about 10 feet per second to about 50 feet per second.

17. The device for stabilization of a flame of claim 15, wherein the fuel flow velocity is in a range from about 2 feet per second to about 10 feet per second.

18. The device for stabilization of a flame of claim 15, wherein said oxidant feed pipe is connected at an angle of about ninety degrees to said oxidant pipe.

19. A device for stabilization of a flame in a combustion apparatus, comprising:

(a) an oxidant pipe having an oxidant pipe internal surface, a circular cross-sectional shape of an oxidant pipe diameter and an oxidant pipe forward end;

(b) a fuel pipe having a fuel pipe internal surface, a fuel pipe external surface, a circular cross-sectional shape of a fuel pipe diameter, and a fuel pipe forward end, said fuel pipe disposed coaxial to said oxidant pipe, and at least a portion of said fuel pipe disposed internal to said oxidant pipe, wherein a hollow cylindrical oxidant flow conduit is formed between said fuel pipe external surface and said oxidant pipe internal surface;

(c) an oxidant feed pipe connected to said oxidant pipe, said oxidant feed pipe having an oxidant feed pipe diameter and connected at an angle to said oxidant pipe such that an oxidant flowing through said oxidant feed pipe is adapted to travel through said oxidant feed pipe and impinge on said fuel pipe external surface and then travel through said oxidant flow conduit to said fuel pipe forward end;

(d) an oxidant flow source for supplying the oxidant at an oxidant flow velocity to said oxidant feed pipe;

(e) a fuel flow source for supplying a fuel at a fuel flow velocity to said fuel pipe;

(f) wherein said oxidant flow velocity is greater than said fuel flow velocity; and (g) wherein said oxidant pipe forward end extends past said fuel pipe forward end by a first length and said fuel pipe extends past an uppermost point of an internal surface of said oxidant feed pipe by a second length;

whereby a mismatch in velocity between flowing fuel and flowing oxidant generates a large scale vortex of the oxidant and fuel as they mix.

20. The device for stabilization of a flame of claim 19, wherein the oxidant flow velocity is in a range from about 10 feet per second to about 50 feet per second.

21. The device for stabilization of a flame of claim 19, wherein the fuel flow velocity is in a range from about 2 feet per second to about 10 feet per second.

22. The device for stabilization of a flame of claim 19, wherein said oxidant feed pipe is connected at an angle of about ninety degrees to said oxidant pipe.

23. The device for stabilization of a flame of claim 19, wherein a ratio of said first length to said oxidant feed pipe diameter is approximately 0.5 to 2.

24. The device for stabilization of a flame of claim 19, wherein a ratio of said second length to said fuel pipe diameter is approximately 1 greater than or equal to about 1.

25. The device for stabilization of a flame of claim 19, wherein a ratio of said oxidant pipe diameter to said fuel pipe diameter is approximately 1.2 to 1.8.

26. The device for stabilization of a flame of claim 19, wherein the oxidant flow velocity is in a range from about 10 feet per second to about 50 feet per second, the fuel flow velocity is in a range from about 2 feet per second to about 10 feet per second, said oxidant feed pipe is connected at an angle of about ninety degrees to said oxidant pipe, a ratio of said first length to said oxidant feed pipe diameter is approximately 0.5 to 2, a ratio of said second length to said fuel pipe diameter is greater than or equal to 1, and a ratio of said oxidant pipe diameter to said fuel pipe diameter is approximately 1.2 to 1.8.

* * * * *